US012465867B2

(12) United States Patent
Kitamoto

(10) Patent No.: US 12,465,867 B2
(45) Date of Patent: Nov. 11, 2025

(54) HIP JOINT STRUCTURE FOR FIGURE, AND FIGURE

(71) Applicant: SEN-TI-NEL CO., LTD., Tokyo (JP)

(72) Inventor: Takashi Kitamoto, Tokyo (JP)

(73) Assignee: SEN-TI-NEL CO., LTD., Tokyo (JP)

( * ) Notice: Subject to any disclaimer, the term of this patent is extended or adjusted under 35 U.S.C. 154(b) by 170 days.

(21) Appl. No.: 18/527,372

(22) Filed: Dec. 4, 2023

(65) Prior Publication Data

US 2024/0181360 A1 Jun. 6, 2024

(30) Foreign Application Priority Data

Dec. 6, 2022 (JP) ..... 2022-194656

(51) Int. Cl.
*A63H 3/46* (2006.01)

(52) U.S. Cl.
CPC ..... *A63H 3/46* (2013.01)

(58) Field of Classification Search
CPC ..... A63H 3/46
See application file for complete search history.

(56) References Cited

U.S. PATENT DOCUMENTS 2,373,963 A * 4/1945 Kallus ..... A63H 3/46 446/380
3,589,061 A * 6/1971 Bear ..... A63H 3/46 446/382
6,033,284 A * 3/2000 Rodriguez Ferre ..... A63H 3/46 446/378
6,220,922 B1 * 4/2001 Lee ..... A63H 3/46 446/385
9,707,487 B2 * 7/2017 Chan ..... A63H 13/06
2013/0109005 A1 * 5/2013 Hardy ..... A63H 3/04 403/53

FOREIGN PATENT DOCUMENTS

| | | |
|---|---|---|
| JP | 2005-034398 A | 2/2005 |
| JP | 3153501 U | 9/2009 |
| JP | 3196196 U | 2/2015 |
| JP | 2022-094667 A | 6/2022 |

* cited by examiner

*Primary Examiner* — John A Ricci
(74) *Attorney, Agent, or Firm* — HAUPTMAN HAM, LLP

(57) ABSTRACT

A hip joint structure includes: right and left hip joint shafts to pivotably couple right and left thigh parts to a body of a figure; and a hip joint cover to cover gaps between the body and the right and left thigh parts. Each of the hip joint shafts is bent outward in a right-and-left direction of the figure while extending from the body toward a corresponding one of the thigh parts. Each of the thigh parts has a hip joint shaft receiving hole to receive a corresponding one of the hip joint shafts, the hip joint shaft receiving hole being formed in an elongated shape. Under a state in which the thigh parts extend straight down from the body, the hip joint shafts extend into the thigh parts, respectively, while extending outward in the right-and-left direction of the figure and downward.

9 Claims, 3 Drawing Sheets

(FRONT SIDE)

(BACK SIDE)

HIP JOINT STRUCTURE FOR FIGURE, AND FIGURE

RELATED APPLICATIONS

The present application claims priority to Japanese Application Number 2022-194656, filed Dec. 6, 2022, the disclosures of which applications are hereby incorporated by reference herein in their entirety.

BACKGROUND

This disclosure relates to a hip joint structure for a figure. This disclosure also relates to a figure having the hip joint structure.

There have been known hip joint structures for a figure as described in, for example, Japanese Patent Application Laid-open No. 2005-34398 and Japanese Utility Model Registration No. 3153501. In general, a hip joint structure for a figure is required not only to provide smoothness of leg movement and a sufficient range of motion of each of legs of the figure but also to make groins of the figure look natural when the legs are spread apart.

With most of related-art hip joint structures for a figure, however, groins of a figure look unnatural and unrealistic when legs of the figure are spread apart. For example, as illustrated in FIG. 7, when legs are spread apart, gaps C are disadvantageously generated at groins, sometimes making an internal hip joint structure K visible from an outside.

SUMMARY

This disclosure has been made in view of the circumstances described above, and has an object to provide a hip joint structure for a figure, which allows legs of a figure to be spread apart at a large angle and is less liable to make groins of the figure look unnatural and unrealistic when the legs are spread apart.

This disclosure has another object to provide a figure having the hip joint structure.

In order to solve the above-mentioned problem, according to this disclosure, there is provided a hip joint structure for a figure, including: a pair of right and left hip joint shafts configured to pivotably couple a pair of right and left thigh parts to a body of a figure; and a hip joint cover configured to cover a gap defined between the body and the right thigh part and a gap defined between the body and the left thigh part. Each of the hip joint shafts is bent outward in a right-and-left direction of the figure while extending from the body toward a corresponding one of the thigh parts. Each of the thigh parts has a hip joint shaft receiving hole configured to receive a corresponding one of the hip joint shafts, the hip joint shaft receiving hole being formed in an elongated shape. Under a state in which the thigh parts extend straight down from the body, the hip joint shafts extend into the thigh parts, respectively, while extending outward in the right-and-left direction of the figure and downward.

According to this disclosure, each of the hip joint shafts is bent outward in the right-and-left direction while extending from the body toward a corresponding one of the thigh parts. The thigh parts have the hip joint shaft receiving holes, each being formed in an elongated shape, respectively. With the configuration described above, the thigh parts can be spread apart at a large angle. In addition, the hip joint shafts, each being curved, extend into the thigh parts, respectively. Hence, the thigh parts are pivoted at positions close to the body. Thus, even when the thigh parts are spread wide apart, the gap defined between the body and the right thigh part and the gap defined between the body and the left thigh part are less liable to be increased. Accordingly, the gaps defined between the body and the thigh parts are more likely to be reliably covered with the hip joint cover. Hence, when the legs of the figure are spread apart, groins are less liable to look unnatural and unrealistic.

As one embodiment of this disclosure, it may be configured that: under the state in which the thigh parts extend straight down from the body, the hip joint shafts first extend inward in the right-and-left direction and then extend outward in the right-and-left direction and downward via bent portions at which the hip joint shafts are bent outward in the right-and-left direction, while extending from top to bottom; the bent portions at which the hip joint shafts are bent outward in the right-and-left direction are located outside the hip joint shaft receiving holes, respectively; and a part of each of the hip joint shafts from a corresponding one of the bent portions, at which the hip joint shafts are bent outward in the right-and-left direction, to a lower end is curved so as to protrude inward in the right-and-left direction and diagonally downward.

As one embodiment of this disclosure, under the state in which the thigh parts extend straight down from the body, each of the hip joint shafts may be bent only in the right-and-left direction over an entire length from an upper end to a lower end of the hip joint shaft.

As one embodiment of this disclosure, the body and each of the hip joint shafts may be connected to each other through intermediation of a spherical pair, and each of the hip joint shafts and a corresponding one of the thigh parts may be connected to each other through intermediation of a spherical pair. In this case, the connections described above are suitable because an orientation of each of the thigh parts with respect to the body can be freely changed to any appropriate direction.

According to this disclosure, there is provided a figure including the hip joint structure.

DESCRIPTION OF THE EMBODIMENTS

Now, an embodiment of this disclosure is described with reference to the accompanying drawings.

Figure 1:
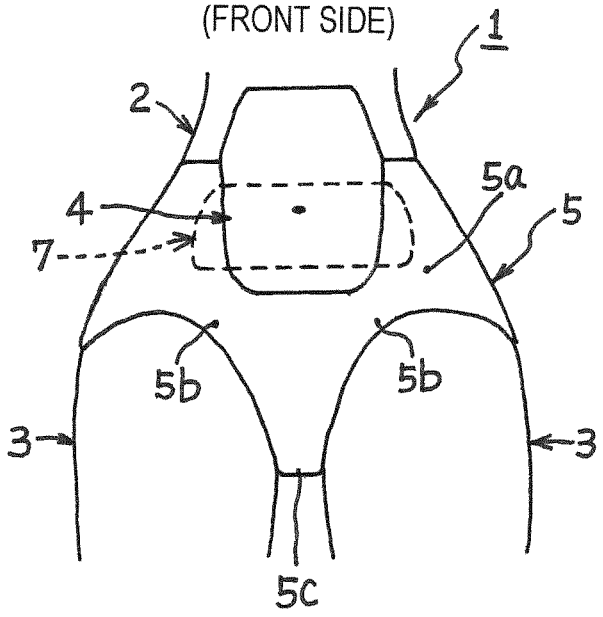
FIG. 1 is a front view of a main part of a figure including a hip joint structure according to one embodiment of this disclosure.
Figure 2:
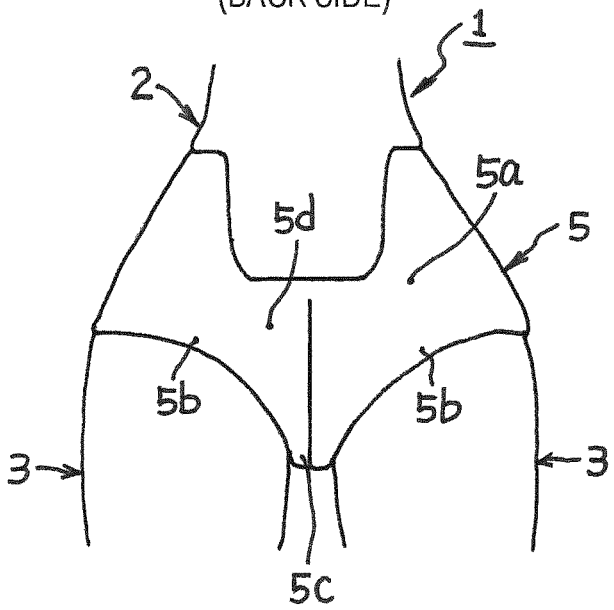
FIG. 2 is a back view of the figure of FIG. 1.

As illustrated in FIG. 1 and FIG. 2, a FIG. 1 according to one embodiment of this disclosure includes a body 2 and a pair of (right and left) thigh parts 3. A front side of an abdomen of the body 2 is covered with an abdomen cover 4. A gap defined between the body 2 and the right thigh part 3 and a gap defined between the body 2 and the left thigh part 3 are covered with a hip joint cover 5. As is well known, the FIG. 1 is made up of a plurality of components. The components of the FIG. 1 are molded articles made of plastic. However, the components are not limited to molded articles made of plastic.

The hip joint cover 5 includes a waist portion 5*a*, right and left groin portions 5*b*, and a crotch portion Sc. The waist portion 5*a* forms a lower abdomen and a waist area of the FIG. 1. Each of the groin portions 5*b* surrounds a groin corresponding to an upper part of the thigh part 3 of the FIG. 1. The crotch portion Sc extends between lower parts of the groin portions 5*b*. A rear side of the hip joint cover 5 forms buttocks 5*d* of the FIG. 1. In order to improve design quality of the FIG. 1, it is preferred that a surface area of the hip joint cover 5 be set as small as possible while the gap defined between the body 2 and the right thigh part 3 and the gap defined between the body 2 and the left thigh part 3 are reliably covered with the hip joint cover 5.

Figure 3:
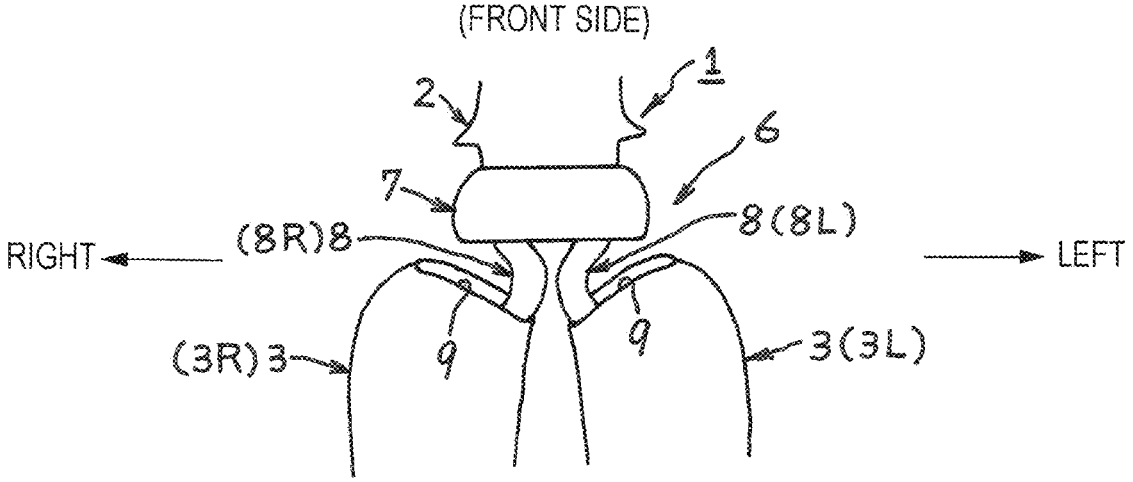
FIG. 3 is a front view of the hip joint structure according to the one embodiment of this disclosure under a state in which an abdomen cover and a hip joint cover are removed from FIG. 1.

After the abdomen cover 4 and the hip joint cover 5 are removed from the FIG. 1 of FIG. 1, a hip joint structure 6 of FIG. 3 according to the one embodiment of this disclosure is exposed. As illustrated in FIG. 3, the FIG. 1 includes a central abdomen member 7 that forms a lower part of the body 2. The central abdomen member 7 is covered with the abdomen cover 4 and the hip joint cover 5 of FIG. 1.

Figure 4:
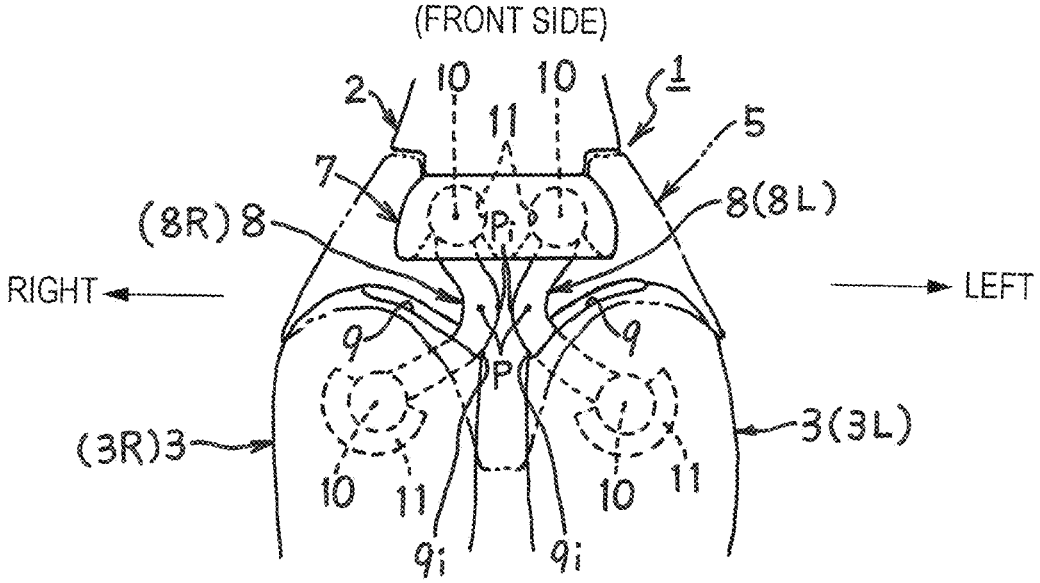
FIG. 4 is a detailed front view of the hip joint structure of FIG. 3.

FIG. 4 is a detailed illustration of FIG. 3 and shows a state in which the thigh parts 3 extend straight down from the body 2. As illustrated in FIG. 4, the central abdomen member 7 and the right thigh part 3 are coupled to each other so as to be pivotable relative to each other through intermediation of a right hip joint shaft 8, and the central abdomen member 7 and the left thigh part 3 are coupled to each other through intermediation of a left hip joint shaft 8 so as to be pivotable relative to each other. Each of the hip joint shafts 8 extends into a corresponding one of the thigh parts 3. Under a state in which the thigh parts 3 extend straight down from the body 2, each of the hip joint shafts 8 is curved only in a right-and-left direction over its entire length from an upper end to a lower end.

Specifically, in the state illustrated in FIG. 4, each of the hip joint shafts 8 extends into a corresponding one of the thigh parts 3 while extending outward in the right-and-left direction of the FIG. 1 and downward. That is, a left hip joint shaft 8L of the FIG. 1 is curved outward to a left side of the FIG. 1 and then extends diagonally into the left thigh part 3L while extending downward from the body 2 toward a left thigh part 3L. A right hip joint shaft 8R of the FIG. 1 is curved outward to the right side of the FIG. 1 and then extends diagonally into the right thigh part 3R while extending downward from the body 2 toward a right thigh part 3R.

More specifically, in the state illustrated in FIG. 4, the right and left (pair of) hip joint shafts 8R and 8L first extend inward in the right-and-left direction and then extend outward in the right-and-left direction and downward via bent portions P at which the right and left hip joint shafts 8R and 8L are bent outward in the right-and-left direction, while extending from top to bottom. A degree of curving is the same for the right and left hip joint shafts 8 of the FIG. 1. The bent portion P at which each of the hip joint shafts 8 is bent outward in the right-and-left direction may be an arcuate curved portion as illustrated in FIG. 4 or a folded portion. A hip joint shaft receiving hole 9 for receiving the hip joint shaft 8 is formed at an upper end of each of the thigh parts 3. Each of the hip joint shaft receiving holes 9 has an elongated shape extending in the right-and-left direction of the FIG. 1. In view of improvement of design quality of the FIG. 1 when its legs are spread apart, it is preferred that a size of each of the hip joint shaft receiving holes 9 be set as small as possible while a motion required for each of the thigh parts 3 is reliably permitted.

The bent portion P at which each of the hip joint shafts 8 is bent outward in the right-and-left direction is located outside a corresponding one of the hip joint shaft receiving holes 9. A part of the hip joint shaft 8 from the bent portion P, at which the hip joint shaft 8 is bent outward in the right-and-left direction, to the lower end is curved so as to protrude inward in the right-and-left direction and diagonally downward. Further, the bent portion P at which each of the hip joint shafts 8 is bent outward in the right-and-left direction has an inner end Pi in the right-and-left direction, and the inner end Pi is located further inside than an inner end 9*i* of each of the hip joint shaft receiving holes 9 in the right-and-left direction.

Figure 5:
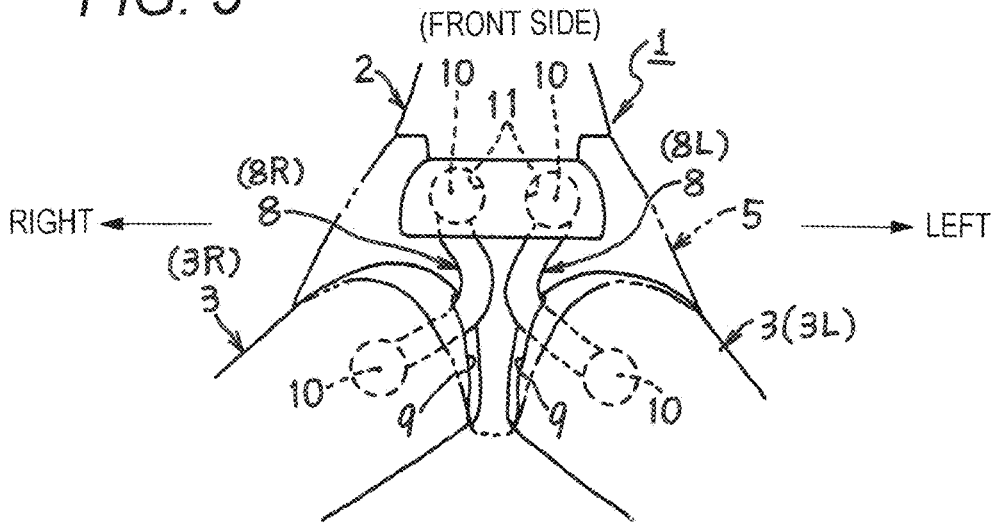
FIG. 5 is a front view of the hip joint structure of FIG. 4 under a state in which both legs of the figure are spread apart to the sides.

In the example of FIG. 4, the bent portion P at which a corresponding one of the hip joint shafts 8 starts extending outward in the right-and-left direction is located outside a corresponding one of the hip joint shaft receiving holes 9. The part of the hip joint shaft 8 from the bent portion P to the lower end is curved so as to protrude inward in the right-and-left direction and diagonally downward. The hip joint shaft receiving holes 9, each having an elongated shape, are formed in the thigh parts 3, respectively. As a result, the thigh parts 3 can be spread apart at a large angle. In addition, the hip joint shafts 8, each being curved, extend into the thigh parts 3, respectively. As a result, the thigh parts 3 are pivoted at positions close to the body 2. Thus, even when the thigh parts 3 are spread wide apart in the right-and-left direction as illustrated in FIG. 5, the gap defined between the body 2 and the right thigh part 3 and the gap defined between the body 2 and the left thigh part 3 are less liable to be increased. Thus, the gaps defined between the body 2 and the thigh parts 3 are more likely to be reliably covered with the hip joint cover 5. Accordingly, when the legs of the FIG. 1 are spread apart, an internal structure of hip joints is less liable to be exposed. Thus, the groins corresponding to the upper parts of the thigh parts 3 are less liable to look unnatural and unrealistic.

As illustrated in FIG. 4, the central abdomen member 7 and each of the hip joint shafts 8 are connected to each other through intermediation of a spherical pair. Similarly, each of the hip join shafts 8 and a corresponding one of the thigh parts 3 are connected to each other through intermediation of a spherical pair. However, the connections are not limited thereto. The above-mentioned connections are suitable because an orientation of each of the thigh parts 3 with respect to the body 2 can be freely changed to any appropriate direction. In the example of FIG. 4, balls 10 are disposed at an upper end and a lower end of each of the hip joint shafts 8, respectively. Correspondingly, ball sockets 11 are disposed on the right and left sides under the central abdomen member 7 and inside the thigh parts 3, respectively. The ball 10 and the ball socket 11 are fitted together so as to be unremovable from each other to thereby form a spherical pair. A relationship between the ball 10 and the ball socket 11 in the example of FIG. 4 is interchangeable. Specifically, the ball sockets 11 may be provided to each of the hip joint shafts 8, and the balls 10 may be provided under the central abdomen member 7 and inside the thigh parts 3.

As a modification example of FIG. 4, the hip joint shafts 8 may be formed such that: the upper ends of the hip joint shafts 8 are arranged closer to each other than those illustrated in FIG. 4; and each of the hip joint shafts 8 first extends straight down from the upper end, then is bent outward in the right-and-left direction, and further extends outward in the right-and-left direction and downward as it is, to reach the lower end.

Each of the hip joint cover 5, the central abdomen member 7, and the thigh parts 3 has been described as a single part. However, in view of ease of molding of the members, it is apparent that each of the members may be formed as an assembled part made up of a plurality of parts. In particular, when each of the central abdomen member 7 and the thigh parts 3 is formed as an assembled part made up of a plurality of parts, there is also an advantage in that it becomes easier to dispose the ball sockets 11 or the balls 10 under the central abdomen member 7 and inside the thigh parts 3.

Figure 6:
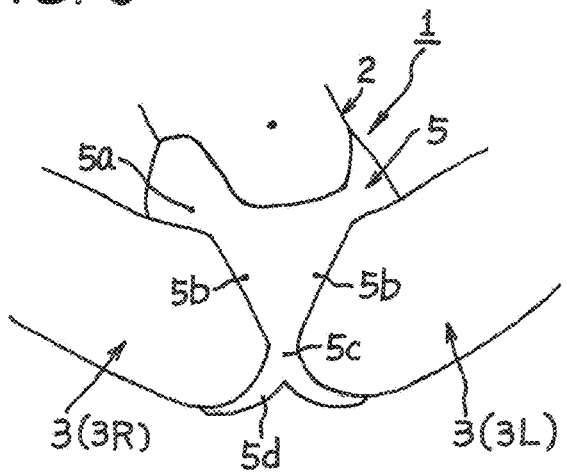
FIG. 6 is a perspective view of the hip joint structure under a state in which the both legs of the figure are pivoted upward from the state of FIG. 5.
Figure 7:
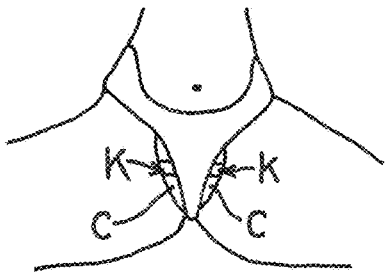
FIG. 7 is a front view of a figure including one example of a related-art hip joint structure under a state in which legs of the figure are spread apart.

When both of the thigh parts 3 are pivoted upward from a leg spread state illustrated in FIG. 5, the thigh parts 3 are brought into a state illustrated in FIG. 6. As described above, in this embodiment, each of the hip joint shafts 8 is connected to the body 2 and a corresponding one of the thigh parts 3 through intermediation of the spherical pairs. Thus, a posture of the FIG. 1 can easily and smoothly be changed from that illustrated in FIG. 5 to that illustrated in FIG. 6. As illustrated in FIG. 6, even when both of the thigh parts 3 are pivoted upward from the leg spread state, the internal structure of the hip joints is not exposed from the hip joint cover 5. Thus, the groins corresponding to the upper parts of the thigh parts 3 look natural and realistic.

When the gaps are exposed from the hip joint cover 5 depending on the orientations of the thigh parts 3, the gaps can be eliminated by pressing the thigh parts 3 into the hip joint cover 5 while the orientations of the thigh parts 3 are maintained. In this case, the thigh parts 3 can easily be pressed into the hip joint cover 5 owing to an action of the spherical pairs.

The embodiments of this disclosure have been described in detail with reference to the drawings. However, a specific configuration is not limited to those of the embodiments described above. For example, changes in design without departing from the gist of this disclosure are encompassed in this disclosure. Further, technologies in the above-mentioned embodiments described above may be used in combination as long as there is no particular contradiction or problem in, for example, purpose and configuration.

What is claimed is:

1. A hip joint structure for a figure, comprising:

a pair of right and left hip joint shafts configured to pivotably couple a pair of right and left thigh parts to a body of a figure; and a hip joint cover configured to cover a gap defined between the body and the right thigh part and a gap defined between the body and the left thigh part, wherein each of the hip joint shafts is bent outward in a right-and-left direction of the figure while extending from the body toward a corresponding one of the thigh parts, wherein each of the thigh parts has a hip joint shaft receiving hole configured to receive a corresponding one of the hip joint shafts, the hip joint shaft receiving hole being formed in an elongated shape, and wherein, under a state in which the thigh parts extend straight down from the body, the hip joint shafts extend into the thigh parts, respectively, while extending outward in the right-and-left direction of the figure and downward.

2. The hip joint structure for a figure according to claim 1, wherein, under the state in which the thigh parts extend straight down from the body, each of the hip joint shafts first extends downward from an upper end of the hip joint shaft, then is bent outward in the right-and-left direction, and further extends outward in the right-and-left direction and downward as it is, to reach a lower end of the hip joint shaft inside each of the thigh parts.

3. The hip joint structure for a figure according to claim 2, wherein a part of each of the hip joint shafts, which extends outward in the right-and-left direction and downward, is curved so as to protrude inward in the right-and-left direction and diagonally downward.

4. The hip joint structure for a figure according to claim 2, wherein each of the hip joint shafts includes a bent portion at which the hip joint shaft is bent outward in the right-and-left direction, and the bent portion is an arcuate curved portion.

5. The hip joint structure for a figure according to claim 2, wherein each of the hip joint shafts includes a bent portion at which the hip joint shaft is bent outward in the right-and-left direction, and an inner end of the bent portion in the right-and-left direction is located further inside than an inner end of each of the hip joint shaft receiving holes in the right-and-left direction.

6. The hip joint structure for a figure according to claim 1, wherein, under the state in which the thigh parts extend straight down from the body, each of the hip joint shafts first extends inward in the right-and-left direction and downward from an upper end of the hip joint shaft, then is bent outward in the right-and-left direction, and further extends outward in the right-and-left direction and downward as it is, to reach a lower end of the hip joint shaft inside each of the thigh parts.

7. The hip joint structure for a figure according to claim 1, wherein, under the state in which the thigh parts extend straight down from the body, each of the hip joint shafts is bent only in the right-and-left direction over an entire length from an upper end to a lower end of the hip joint shaft.

8. The hip joint structure for a figure according to claim 1, wherein the body and each of the hip joint shafts are connected to each other through intermediation of a spherical pair, and each of the hip joint shafts and a corresponding one of the thigh parts are connected to each other through intermediation of a spherical pair.

9. A figure comprising the hip joint structure of claim 1.

* * * * *